US005460022A

United States Patent [19]

Parsons

[11] Patent Number: 5,460,022

[45] Date of Patent: Oct. 24, 1995

[54] CONCEALED HANDCUFF KEY

[75] Inventor: Kevin L. Parsons, Appleton, Wis.

[73] Assignee: Armament Systems and Procedures, Inc., Appleton, Wis.

[21] Appl. No.: 109,763

[22] Filed: Aug. 20, 1993

[51] Int. Cl.[6] ..... A47G 29/10

[52] U.S. Cl. ..... 70/456 R; 7/118; 7/168; 70/459; 206/37.1; 206/37.4; 206/37.8; 401/52; 401/195; D19/36

[58] Field of Search ..... 70/456 R, 459, 70/460; 401/52, 195; 7/118, 168; 19/36; 206/38.1, 37.1, 37.4, 37.6, 37.8; 24/3 K, 3.6

[56] References Cited

U.S. PATENT DOCUMENTS

| | | | |
|---|---|---|---|
| D. 206,875 | 2/1967 | Mosch | D19/36 X |
| 373,580 | 11/1887 | Boynton | 70/456 R X |
| 470,997 | 3/1892 | Fairchild | 401/52 |
| 807,402 | 12/1905 | Scanlan | 70/456 R |
| 864,703 | 8/1907 | Sibley | 7/119 |
| 2,105,763 | 1/1938 | De Berry | 70/456 R |
| 2,141,061 | 12/1938 | Dodson | 401/52 X |
| 2,274,820 | 3/1942 | Bills . | |
| 2,344,581 | 3/1944 | Ziegeweid | 70/456 R |
| 2,371,308 | 3/1945 | Mosch . | |
| 2,481,359 | 9/1949 | Smyser et al. | 70/456 R |
| 2,558,265 | 5/1951 | Mosch . | |
| 2,637,994 | 5/1953 | Harrison, Jr. et al. | 70/456 R |
| 2,706,902 | 4/1955 | Nichols | 70/456 R |
| 2,789,613 | 4/1957 | Corsaw . | |
| 2,982,454 | 5/1961 | Wolberg . | |
| 3,292,400 | 12/1966 | Merila | 70/456 R |
| 3,355,917 | 12/1967 | Albert . | |
| 3,436,942 | 4/1969 | Procter | 70/456 R |
| 3,527,072 | 9/1970 | Demetreon | 70/456 R |
| 4,253,321 | 3/1981 | Sorensen | 70/456 R |
| 4,646,913 | 3/1987 | Wing et al. | 206/37.2 |
| 4,778,302 | 10/1988 | Martinez | 70/456 R X |
| 4,852,374 | 8/1989 | Gotanda | 70/456 R |
| 4,941,569 | 7/1990 | Lindmayer et al. | 206/38.1 |
| 5,228,563 | 7/1993 | Stringham | 206/37.8 X |

FOREIGN PATENT DOCUMENTS

| | | | |
|---|---|---|---|
| 0088699 | 9/1983 | European Pat. Off. | 70/456 R |
| 0170762 | 2/1986 | European Pat. Off. | 401/195 |
| 2574264 | 6/1986 | France | 206/37.4 |
| 245375 | 4/1912 | Germany | 70/456 R |
| 325530 | 9/1920 | Germany | 70/456 R |
| 2726698 | 1/1979 | Germany | 70/456 R |
| 464825 | 7/1951 | Italy | 70/456 R |

*Primary Examiner*—Lloyd A. Gall

*Attorney, Agent, or Firm*—Robert C. Curfiss; Butler & Binion

[57] ABSTRACT

A device for concealing, storing and permitting ready access to and use of a handcuff key which is not readily identifiable as a key holder but is easily retrieved and utilized by law enforcement personnel. The handcuff key is camouflaged and concealed in a variety of devices, such as a ball point pen enclosure, a pocket knife holder and a rectangular case.

15 Claims, 3 Drawing Sheets

CONCEALED HANDCUFF KEY

BACKGROUND OF INVENTION

1. Field of Invention

This invention is generally related to restraining devices for use by law enforcement personnel and is specifically directed to a concealed key for a lockable restraining device such as handcuffs.

2. Description of Prior Art

In general, a variety of holding cases are available for carrying and concealing keys. A key is often contained in a device which holds other items such as cigarette lighters, tobacco tamps, flashlights, lipstick and manicure tools. A key may also be contained with a multiplicity of other keys in a compact fashion. Keys may be enclosed in holders designed for particular items of clothing, such as on a belt or in a shirt or vest pocket. These prior art key holding devices support an assortment of everyday personal use keys and generally fall into the category of novelty items. Novelty key cases are primarily cosmetic in nature and are designed to cleverly package a key as an accessory. While such novelty key cases are generally useful for their intended purpose, none are suitable for the specific needs of law enforcement personnel, particularly with respect to the concealment of special purpose keys such as handcuff keys and the like.

Specifically, the prior art key cases are not designed for concealing, storing or improving utilization of a handcuff key, which typically presents specific problems for law enforcement personnel. Generally, the standard handcuff key carried by law enforcement personnel is "L" shaped with relatively sharp corners and edges and can be used to unlock any set of standard handcuffs. If carried on a typical key chain in the pocket, the sharp corners and edges can snag clothing and, at times, even gouge the skin. Further, a handcuff key carried on a typical key chain is clearly visible. Because it can be used to free any detainee restrained by standard handcuffs, a visible handcuff key creates a risk of theft from law enforcement personnel. Moreover, an undercover officer may be exposed by carrying a handcuff key on a typical key chain where a suspect can identify it.

While prior art key cases may provide an enclosure which protects the carrier's clothing from damage, there are several disadvantages to carrying a handcuff key in a standard key case. For example, most prior art key cases are designed to hold a plurality of keys. Although convenient for storage, such a design makes it difficult to quickly retrieve a specific key, which is often the requirement with handcuff keys. Also, since standard key cases are not adapted to carry handcuff keys, it may be difficult to use the key without removing it from the case. Another disadvantage is that storing a handcuff key with other "standard" keys does not conceal the key in any manner but actually makes the key more "visible" by keeping it in a logical place. A handcuff key should be enclosed and concealed from the general public while at the same time be readily discernible and accessible to law enforcement personnel or other proper parties.

Handcuffs and handcuff keys are an important part of the official issue equipment carried on the person of law enforcement personnel. Ready access to both are essential in many situations. A concealed key may be not be readily discernible and easily retrieved. Moreover, an unconcealed key, while readily accessible, presents its own hazards, such as snagging of clothing or providing a visible form of identity of an undercover officer.

Therefore, there exists a need for a device for concealing, storing and permitting ready use of a handcuff key wherein the device is not readily identified as a key holder and the handcuff key is conveniently stored but is readily accessible by law enforcement personnel.

SUMMARY OF THE INVENTION

The subject invention is specifically directed to a device for concealing, storing and permitting use of a handcuff key. The device of the invention not only protects and conceals the key in a device which is not readily identifiable as a key holder, but also provides for easy retrieval and utilization of the handcuff key. While the subject invention is illustrated in three preferred embodiments encompassing a slidable handcuff key in a carrying case, a key concealed in a ball point pen and a handcuff key concealed in a pocket knife, it will be understood that other similar concealing cases may be used in accordance with the teachings of the invention.

All of the illustrated embodiments serve to conceal a typical handcuff key in a camouflaged manner while at the same time making the key readily accessible for proper use. In addition, each embodiment may be adapted for carrying and concealing a locking pin of the type used with many handcuffs. By way of explanation, a locking pin is an elongated probe used in conjunction with a handcuff key. In many typical applications, the handcuffs are double locked to prevent picking or shimming. This is done through use of a pin which sets the double lock mechanism after which the handcuffs will no longer continue to tighten. The double lock mechanism increases the security of handcuff restraining devices. Therefore, while the concealed key embodiments need not contain a locking pin device, it has been found convenient and often desirable to also enclose this pin with the handcuff key, and each embodiment can be adapted for this purpose.

In the first embodiment, a handcuff key is concealed in a typical ball point pen. The pen enclosure is basically a cylindrical housing or barrel that is hollow and adapted for receiving a standard pen cartridge. In the illustrated embodiment, a twist action pen, such as the well-known Cross pen set, can be used. However, the invention is not so limited and it is understood that any type of ball point pen may be suitably adapted for the purposes described herein. In the preferred embodiment, the main section of the barrel includes a tapered conical shaped open tip at one end and an open outer end to which the removable cap is secured. A threaded liner is mounted for axial rotation within the main section and partially extends into the removable cap. A handcuff key is mounted to a cylindrical shaft which is attached to the pen cartridge. If preferred, the handcuff key does not have to be connected to the pen cartridge but can be mounted directly to the liner. The liner is adapted to receive the pen cartridge in the main section of the pen and the handcuff key attached thereto extends into the removable cap. The handcuff key is exposed and used by removing the cap and is concealed by securing the cap to the main section. When the liner is rotated in a clockwise direction, the ball point is axially extended through the open tip of the main section and may be used as a typical pen.

If desired, a locking pin may also be concealed in the pen enclosure. In one embodiment, the pen cartridge is replaced with a locking pin specifically designed for use in the pen. The locking pin may be attached to the pen enclosure in the same manner and location as the cartridge. The pin is axially extended from the pen enclosure, for use as the locking pin, in the same manner as the pen is extended and retracted through the open tip of the main section.

The second illustrated embodiment conceals a handcuff key in a typical pocket knife enclosure, such as, by way of example, a Swiss army knife. In this embodiment, the handcuff key is pivotally mounted to one end of the pocket knife holder and is adapted to be folded into and out of the holder in the same manner as a knife blade or any other tool typically carried in the knife case. The handcuff key is pulled from its storage position to a locked extended position for use. In the preferred embodiment, the pocket knife holder includes at least one knife blade pivotally mounted to one end and a handcuff key pivotally mounted to the opposite end. Additional tools, such as a screwdriver, may also be similarly mounted. Each tool can be pivoted to an extended locked position for use and returned to a concealed pocket or channel in the case and locked in position for storage. Although the preferred embodiment includes the key, at least one knife blade and an additional tool, it will be understood that other tools may be substituted or included. If desired, a locking pin may also be similarly concealed in this device. For example, the screwdriver may be replaced by a locking pin which is extendable and retractable in the same manner as the handcuff key. Alternatively, the locking pin may be fixedly mounted on the outer perimeter of the holder.

In the third illustrated embodiment, the handcuff key is concealed in a hollow rectangular shaped casing having a molded handle for defining a key chain carrier or the like. Thus, the rectangular case is suitable for carrying a concealed handcuff key on a typical key chain. The rectangular case has an elongated slot, openings at opposite ends of the case and a button slide in the slot and in communication with the handcuff key shaft for sliding the handcuff key from its concealed position inside the case to an exposed position for use. If desired, a locking pin may be included at the opposite end of the key shaft. The handcuff key is connected to a slide plate which is held in a locked position by a resilient spring. The device is operated by moving the slide plate along an elongated slot or track in the casing to advance the key into a position for use. The slide plate is adapted to be moved when a downward force is exerted on the button which projects through the elongated slot and is connected to the slide plate. The elongated slot includes three notches which indicate a central position, a first locked position and a second locked position. When the projecting button is moved into the first position, the handcuff key is extended through the opening at one end of the case and locked into a position for use once the button is released. In the central position, the handcuff key, and if included, the locking pin, are completely enclosed within the rectangular case. If a locking pin is included, the pin is similarly extended through the opening at the opposite end of the case when the button is moved into the second position and locked when it is released.

The rectangular case typically includes a molded handle to which a key ring may be attached. The molded handle contains a center opening to allow the key ring to be moved from one end of the device to the other end. This allows full use of the handcuff key and pin without removing the case from the key ring.

The illustrated embodiments disclose a variety of devices for concealing, storing and permitting ready access to and use of a handcuff key.

Therefore, it is an object and feature of the subject invention to provide a device for concealing, storing and permitting ready access to and use of a handcuff key.

It is a further object and feature of the subject invention to provide a device for concealing the handcuff key within a ball point pen enclosure.

It is yet another object and feature of the subject invention to provide a device for concealing the handcuff key within a pocket knife holder.

It is a further object and feature of the subject invention to provide a device for concealing the handcuff key within a rectangular slide casing.

It is another object and feature of the subject invention to provide a device for concealing a locking pin in combination with a concealed handcuff key.

These and other objects and features of the subject invention will be readily apparent from the accompanying drawings and detailed description of the preferred embodiments.

DETAILED DESCRIPTION OF THE PREFERRED EMBODIMENTS

Figure 6:
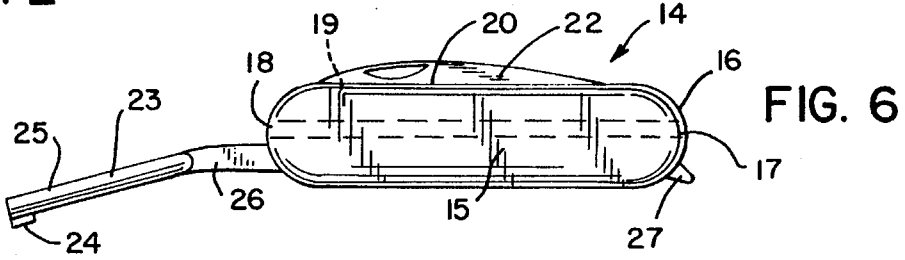
FIG. 6 is a perspective view of the pocket knife enclosure showing the handcuff key in an extended position for use.
Figure 7:
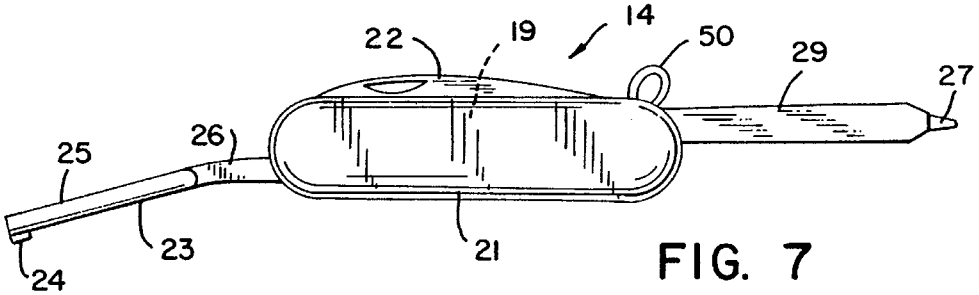
FIG. 7 is a perspective view of the pocket knife enclosure showing the extended handcuff key with an alternative embodiment of the locking pin in an extended position for use.
Figure 3:
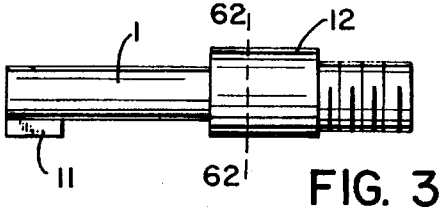
FIG. 3 is a side elevation view of the handcuff key as mounted within the pen enclosure housing.
Figure 5:
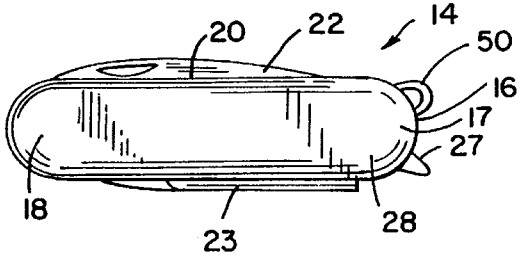
FIG. 5 is a perspective view of a pocket knife enclosure showing the handcuff key in a concealed storage position and one embodiment of the locking pin.

FIGS. 1 to 4 represent the first preferred embodiment of the invention designated generally as the pen enclosure. FIGS. 5 to 7 represent the second preferred embodiment of the invention designated generally as the pocket knife enclosure. FIGS. 8 to 11 represent the third preferred embodiment of the invention designated generally as the rectangular casing enclosure.

Referring now specifically to FIGS. 1–4, a handcuff key 1 is concealed within a typical, prior art pen enclosure 2. The pen enclosure 2 includes a cylindrical housing or barrel 3 which is divided into a main section 4 and a removable cap 5. The main section 4 has a tapered, conical shaped open end 6 and an open outer end 7. A threaded liner 8 is mounted for rotation within the main section 4. The liner partially extends into the removable cap 5 and is shaped to frictionally secure the removable cap 5 to the open outer end 7 of the main section 4 thereby forming the pen enclosure 2. As is typical, the liner 8 is adapted to receive a pen cartridge 9 having a ball point 10. The cartridge 9 is externally threaded at 8*a* for engaging the threaded liner 8, whereby the liner 8 can be rotated in a clockwise direction and in a counter-clockwise direction to move the liner relative to the cartridge for extending and retracting the ball point 10 through the tapered end 6 of the main section 4. It will be understood that other ball point pen configurations could be used without departing from the scope and spirit of the present invention.

The handcuff key 1 is essentially L-shaped and has a flat rectangular latch tab 11. The handcuff key 1 is located within the pen enclosure 2 and is mounted to a cylindrical shaft 12. The shaft 12 may be secured to the liner 8 or, alternatively, may be secured directly to the pen cartridge 9. The handcuff key 1 extends axially into the removable cap 5 and the entire key is concealed by the removable cap 5. The handcuff key 1 is functional simply by removing the cap 5 and exposing the key.

It is desirable to secure the threaded portion 52 of shaft 12 to the liner 8 in a manner which keeps the handcuff key from disengaging the liner 8 when the handcuff key is used. In a typical pen, the pen cylinder uses a thread with a right hand twist to hold the ink cartridge in place. To release a handcuff, the handcuff key is turned in a counterclockwise direction. In order to avoid unscrewing the threaded portion 52 from liner 8 when using the handcuff key, the handcuff key must be locked into position.

Figure 4:
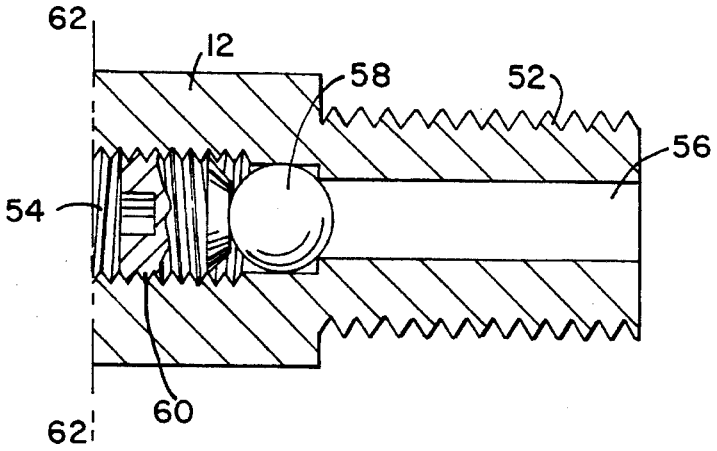
FIG. 4 is an enlarged view of the handcuff key to be mounted within the pen enclosure.
Figure 11:
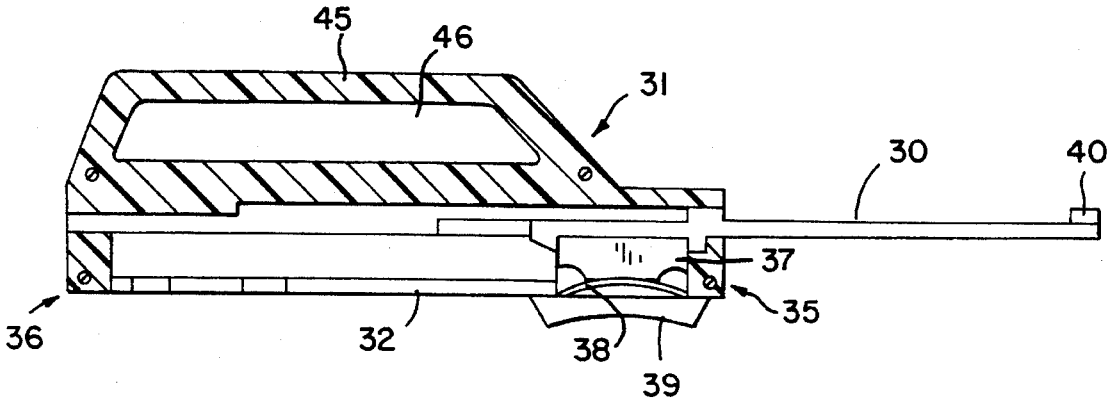
FIG. 11 is a cross-sectional view of the interior of the casing showing the key connected to the slide plate, the spring and the actuator button.

In the preferred embodiment, the locking mechanism is defined by modifying lower portion 52 to form a tight lock with the liner 8. As shown in FIG. 4, the handcuff key 1 includes a channel 54 which is provided through the center of the handcuff key 1 and the shaft 12. At the lower threaded portion 52, the channel 54 narrows into a second channel 56 having a smaller diameter than channel 54. As seen in FIG. 4, an expansion member 58, such as a stainless steel ball, is adapted to fit in the channel 54 provided through the handcuff key 1 and the shaft 12. The expansion member 58 is placed in the channel 54 and rests at the bottom of shaft 12. The channel 54 is threaded along shaft 12 to receive a set screw 60. The set screw 60 is installed in the channel 54 after the expansion member 58 has been placed in the channel 54. When the set screw 60 is tightened, the set screw pushes against the expansion member 58 and forces it into the second channel 56. This action causes the lower threaded portion 52 to spread and locks it tightly against the wall of liner 8.

In practice, the handcuff key is initially secured within the pen enclosure 2 by inserting threaded portion 52 and screwing it to the liner 8. The handcuff key is then locked into place by tightening the set screw 60. The set screw may be tightened by inserting an Allen wrench or other suitable means into the channel 54, thereby forcing the expansion member 58 into the second channel 56. When the expansion member 58 is forced into the second channel 56, the diameter of the lower threaded portion 52 is increased and a tight lock is formed. Thus, the handcuff key is secured and can be used without causing the threaded portion 52 to disengage from the liner 8 thereby releasing the handcuff key 1 and pen cartridge 9 from the pen enclosure.

Figure 1:
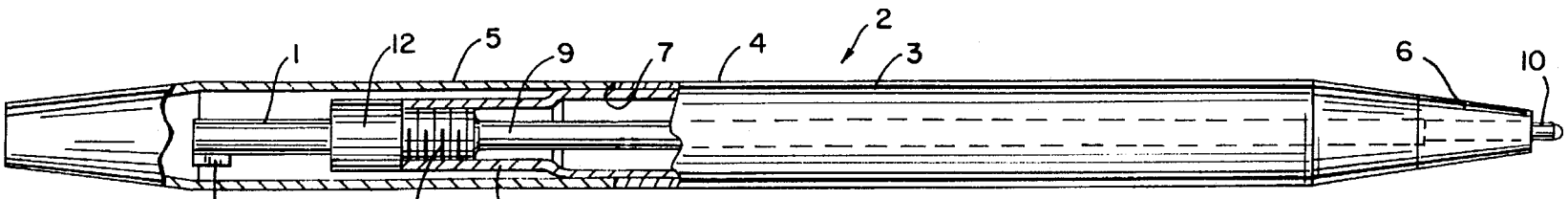
FIG. 1 is a perspective view of a pen enclosure containing a handcuff key in a ball point pen enclosure, partially broken away.
Figure 2:
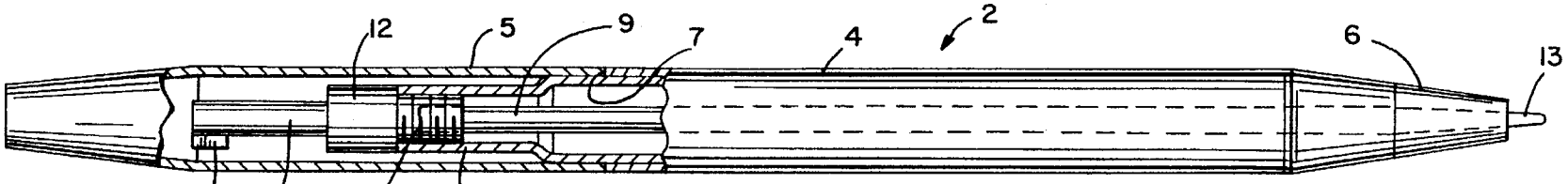
FIG. 2 is a perspective view of the pen enclosure of FIG. 1 containing both a handcuff key and a locking pin.

As embodied in FIG. 2, a locking pin 13 may also be concealed in the pen enclosure 2. The locking pin 13 will replace the pen cartridge 9 in the liner 8. Upon removing the pen cartridge 9, the locking pin 13 is fitted into the pen enclosure 2 within the liner 8 in an identical manner to the pen cartridge 9. Consequently, in the illustrated embodiment, the liner 8 can be rotated in a clockwise direction to extend and in a counter-clockwise direction to retract the locking pin 13 through the tapered end 6 of the main section 4.

With reference to the embodiment depicted in FIGS. 5, 6 and 7, a handcuff key 23 is concealed in a typical, prior art pocket knife holder 14. The pocket knife holder 14 such as, by was of example, a Swiss army brand pocketknife, includes a top cover 15 and a bottom cover 16 and opposite ends 17 and 18. An interior wall 19 joins the covers 15 and 16 and creates a first channel 20 and a second channel 21. The pocket knife holder 14 includes at least one knife blade 22 pivotally mounted at one end 17 and adapted to be retracted into and extended out of the first channel 20. In its retracted storage position, the knife blade 22 is adapted to rest against interior wall 19. In the preferred embodiment, a handcuff key 23 is pivotally mounted to the opposite end 18 and is adapted to be retracted into and extended out of the second channel 21 in the same manner as a typical knife blade. The handcuff key 23 is adapted to rest against interior wall 19 in its retracted storage position. The handcuff key 23 is essentially L-shaped and has a flat rectangular latch 24. In the illustrated embodiment, the handcuff key 23 has a first section 25 which includes the rectangular latch 24 and a second section 26. The first section 25 is connected to the second section 26 and the second section 26 is pivotally mounted to the holder 14 at end 18. The two sections 25, 26 may be foldable relative to one another or may be secured in a fixed position.

A locking pin 27 may also be concealed in the pocket knife holder 14. As shown in FIGS. 5 and 6, the pin 27 may be permanently secured on the outside of the holder 14 at position 28. Alternatively, as shown in FIG. 7, the locking pin may also be secured on an elongated shaft 29 which is pivotally mounted to holder 14 and the pin 27 is pivotally retractable and extendable into the holder 14 in the same manner as the knife blade 22. In addition, a ring 50 is mounted to the holder 14 for carrying the holder by securing it to a typical key ring.

Figure 8:
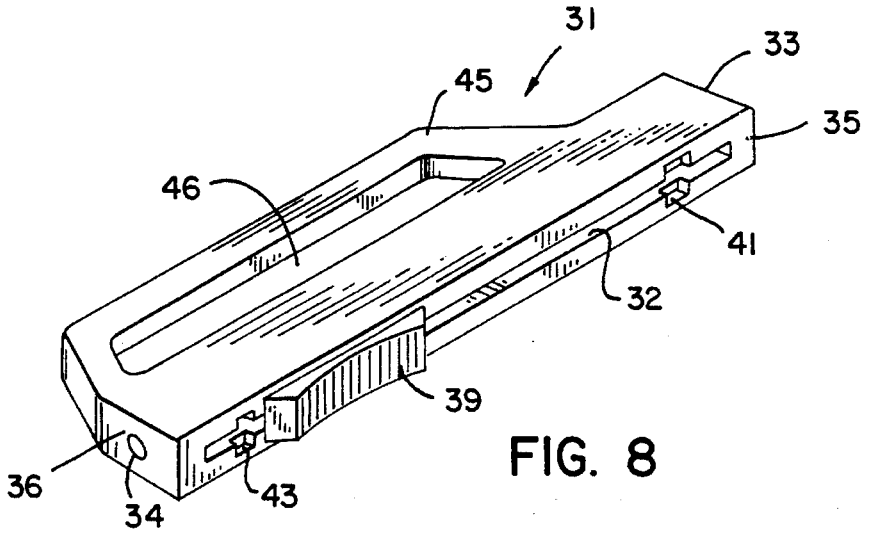
FIG. 8 is a perspective view of a rectangular shaped casing for concealing the handcuff key.
Figure 9:
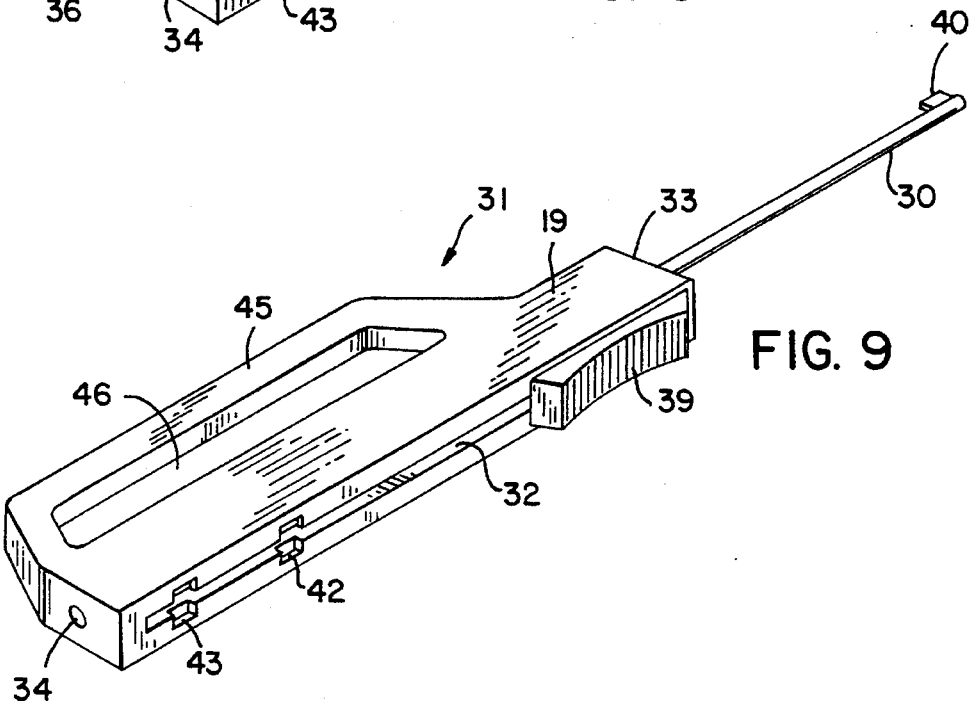
FIG. 9 is a perspective view of the rectangular shaped casing showing the handcuff key in an extended position for use.
Figure 10:
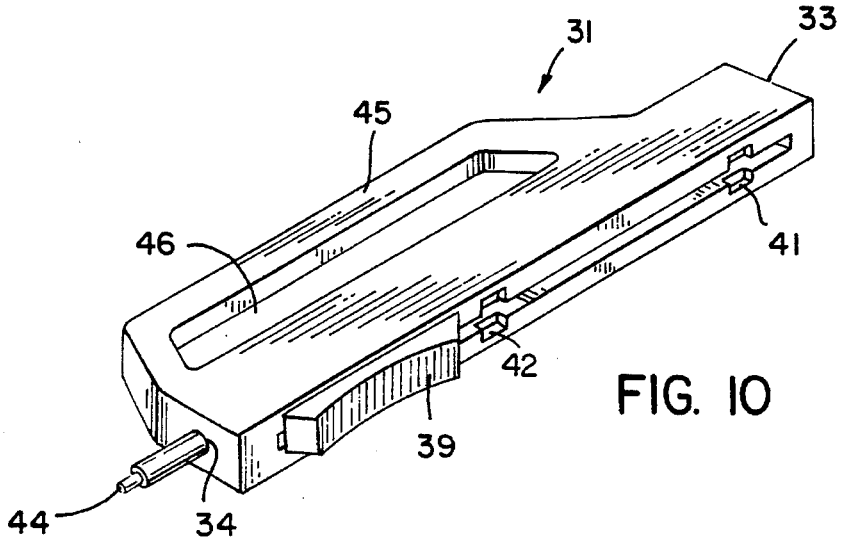
FIG. 10 is a perspective view of the rectangular shaped casing showing a locking pin in an extended position for use.

With specific reference to the embodiment depicted in FIGS. 8, 9, 10 and 11, the handcuff key 30 is concealed in a hollow rectangular casing 31 having an elongated slot 32 and openings 33, 34 at opposite ends 35, 36. As shown in FIG. 10, a slide plate 37 is adapted to slide along the length of the elongated slot 32. In the preferred embodiment, the handcuff key 30 is connected directly to the slide plate 37 which is mounted on key shaft 30'. A projecting button 39 is also connected to the slide plate 37 and projects through the elongated slot 32. A resilient member, such as the leaf spring 38, is positioned between the button and the slide plate 37. The elongated slot 32 includes three notched stopping points 41, 42, 43. The resilient spring 38 urges the button 39 upward to lock the button, slide plate and handcuff key in position when one of the three notched stopping points is encountered. The slide plate 37 is moved along the slot 32 by exerting a downward force on the projecting button 39, thereby releasing it from its locked position, and pushing the button in either direction along the slot 32 to one of the stopping points 41, 42, 43. As shown in FIG. 9, when the button 39 is moved to the first stopping point 41, the handcuff key 30 is extended through the opening 33 and locked into a position for use.

If desired, a locking pin 44 may also be concealed in the rectangular casing 31. As illustrated in FIG. 10, the locking pin 44 is extended through opening 34 when the button 39 is moved to the second stopping point 43. The locking pin 44 is a cylindrical probe for setting and releasing a handcuff key lock. As described with reference to the slidable handcuff key 30, the locking pin 44 is held in a locked position by the force of the spring 38 urging the button 39 upward. In FIG. 8, the button 39 is shown at stopping point 42 at which the handcuff key 30 and locking pin 44 are both concealed within the rectangular case 31.

In the preferred embodiment, a handle 45 is molded to the side of the casing 31 which is opposite to the side containing the elongated slot 32. The handle 45 is adapted to be attached to a typical key ring for carrying the rectangular case 31. The handle 45 includes an elongated opening 46 adapted to allow an attached key ring to be moved from one end of the casing 31 to the other end in order to facilitate use of the handcuff key 30 and locking pin 44 without removing the casing 31 from the key ring. The key and pin, respectively, may be used by holding the key ring in the palm of the hand and grasping the casing between the thumb and forefinger.

While certain features and embodiments of the invention have been described in detail herein, it will be readily understood that the invention encompasses all modifications and enhancements within the scope and spirit of the following claims.

What is claimed is:

1. A concealed handcuff key in a key case comprising:

a. a rectangular case having a key compartment chamber, an elongated slot, openings at opposite ends of the case and a handle molded to said case;

b. a key shaft with two opposite ends, and including the handcuff key mounted at one end, said handcuff key having a flat, rectangular latch adapted to release a handcuff lock; and c. a slide plate slidably disposed within the rectangular case having a projecting button and connected to the key shaft for extending and retracting the handcuff key from a storage position through the opening at one end into a position for use whereby said handcuff key is stored and concealed within the case.

2. The concealed handcuff key in a key case of claim 1, the key shaft further including a locking pin located at the opposite end from the handcuff key, said locking pin being adapted to set and release a handcuff lock and whereby said locking pin is stored and concealed within the case.

3. The concealed handcuff key in a key case of claim 2, the opening at the opposite end of the rectangular case being formed to allow the extension and retraction of the locking pin through the opening.

4. The concealed handcuff key in a key case of claim 2, said handle for attaching the case to a key ring and adapted to permit use of the handcuff key and locking pin while the case is attached to a key ring.

5. The concealed handcuff key in a key case of claim 1, the opening at one end of the rectangular case being formed in the shape of the handcuff key to allow the extension and retraction of the handcuff key through the opening.

6. The concealed handcuff key in a key case of claim 1, said handle for attaching the case to a key ring and adapted to permit use of the handcuff key while the case is attached to a key ring.

7. The concealed handcuff key in a key case of claim 1, the elongated slot further including three notched stopping points comprising:

a. a center stopping point identifying a storage position wherein the entire key shaft is enclosed within the rectangular case;

b. a first stopping point identifying a first locked position wherein the handcuff key is extended through the opening at one end of the case; and c. a second stopping point identifying a second locked position wherein the key shaft is enclosed within the rectangular case.

8. The concealed handcuff key in a key case of claim 7, wherein the key shaft further including a locking pin located at the opposite end from the handcuff key whereby:

a. the first stopping point identifies a first locked position wherein the locking pin is enclosed within the rectangular case and the handcuff key is extended for use; and b. the second stopping point identifies a second locked position wherein the locking pin is extended through the opening at one end of the case and the handcuff key is enclosed within the rectangular case.

9. The concealed handcuff key in a key case of claim 7, the slide plate further comprising:

a. a spring adapted to urge the projecting button upward into a locked position at the center, first or second stopping points; and b. the projecting button adapted for moving the slide plate along the elongated slot by applying a downward force on the button to overcome the upward force exerted by the spring thereby allowing the slide plate to be moved in either direction along the slot to the center, first or second stopping points.

10. The concealed handcuff key in a key case of claim 7, the slide plate further comprising two side walls, a top section and a bottom section wherein a. the two side walls are adapted to slide along an inner ridge extending the length of each side of the elongated slot;

b. the top section includes the projecting button which projects through the elongated slot; and c. the bottom section is shaped to allow insertion of the key shaft thereby creating a means for connecting the slide plate to the key shaft.

11. The concealed handcuff key in a key case of claim 10, wherein the key shaft includes a locking pin whereby movement of the projecting button causes the slide plate to move providing means for the extension and retraction of the locking pin through the opening at the opposite end of the case.

12. A pocket knife and handcuff key combination comprising a pocket knife of the type having:

a. a pocket knife case including a top and a bottom cover having an interior wall and opposite ends;

b. a knife blade pivotally mounted within the top and bottom cover at one end of the case;

c. the handcuff key having a cylindrical body with opposite ends, one end including a flat, rectangular latch adapted to release a handcuff lock and the other end being pivotably mounted within the top and bottom cover at the opposite end of the case; and d. a locking pin having a cylindrical probe adapted to set and release a handcuff lock, the locking pin including a shaft which is pivotally mounted within the top and bottom cover.

13. The pocket knife and handcuff key combination of claim 12, whereby the top and bottom cover are joined by the interior wall which extends the length of said covers and is adapted to form a first and second channel within the case.

14. The pocket knife and handcuff key combination of claim 13, wherein the knife blade is pivotally extendable from and retractable into the first channel, and the handcuff key and locking pin are pivotally extendable from and retractable into the second channel.

15. The pocket knife and handcuff key combination of claim 14, the case further including a ring connected to one end of the case for attaching the pocket knife and handcuff key combination to a key ring.

* * * * *